US005372179A

United States Patent [19]

Sakakibara et al.

[11] Patent Number: 5,372,179

[45] Date of Patent: * Dec. 13, 1994

[54] MOLD SURFACE TREATMENT PROCESS AND MOLD

[75] Inventors: Yuji Sakakibara, Aichi; Takatoshi Suzuki, Anjo; Hiroaki Hayashi, Aichi; Yasuo Takada; Akihiko Suda, both of Nagoya; Yoshiro Hayashi; Kenji Kaida, both of Toyota; Ryuuichi Masuda; Masahiro Taguchi, both of Okazaki, all of Japan

[73] Assignees: Kabushiki Kaisha Toyota Chuo Kenkyusho, Aichi; Toyota Jidosha Kabushiki Kaisha, Toyota, both of Japan

[ * ] Notice: The portion of the term of this patent subsequent to Jun. 19, 2007 has been disclaimed.

[21] Appl. No.: 145,468

[22] Filed: Oct. 22, 1993

Related U.S. Application Data

[63] Continuation of Ser. No. 753,030, Aug. 26, 1991, abandoned, which is a continuation of Ser. No. 506,457, Apr. 9, 1990, abandoned, which is a continuation-in-part of Ser. No. 238,848, Sep. 1, 1988, Pat. No. 4,934,440.

[30] Foreign Application Priority Data

| | | | |
|---|---|---|---|
| Sep. 5, 1987 | [JP] | Japan | 62-222646 |
| Sep. 17, 1987 | [JP] | Japan | 62-233575 |
| Jan. 28, 1988 | [JP] | Japan | 63-017578 |

[51] Int. Cl.[5] ..... B22C 3/00

[52] U.S. Cl. ..... 164/349; 164/529; 164/138; 164/14

[58] Field of Search ..... 164/14, 138, 349, 529, 164/523; 427/134

[56] References Cited

U.S. PATENT DOCUMENTS

| | | | |
|---|---|---|---|
| 3,520,711 | 7/1970 | Bish et al. | 427/134 |
| 3,590,903 | 7/1971 | Taylor | 164/53 |
| 4,934,440 | 6/1990 | Sakakibara | 164/14 |

FOREIGN PATENT DOCUMENTS

| | | | |
|---|---|---|---|
| 2559691 | 8/1985 | France | 164/14 |
| 1184908 | 3/1970 | United Kingdom | 164/138 |
| 2124116 | 2/1984 | United Kingdom | 164/14 |

*Primary Examiner*—P. Austin Bradley
*Assistant Examiner*—Erik R. Puknys
*Attorney, Agent, or Firm*—Oblon, Spivak, McClelland, Maier, & Neustadt

[57] ABSTRACT

A mold comprising a cavity for defining the shape of a casting and a mold body for forming said cavity, comprising: a mold body formed of an ordinary temperature setting resin or thermosetting resin and casting sand, said mold body having a surface layer portion on the surfaces thereof including depressions, said depressions in the surface layer portion being filled up with at least one porous powdered material selected from the group consisting of hydrous magnesium silicate clay mineral, activated carbon and activated alumina, thereby providing the mold body with smooth surfaces whereby said mold generates less amount of material such as gums which cause defective castings during casting since molten metal is restrained from intruding into the walls of said mold.

3 Claims, 4 Drawing Sheets

MOLD SURFACE TREATMENT PROCESS AND MOLD

CROSS REFERENCE TO RELATED APPLICATIONS

This application is a continuation of Ser. No. 07/753,030, filed on Aug. 26, 1991, now abandoned, which is a continuation of Ser. No. 07/506,457 filed Apr. 9, 1990 now abandoned which is a continuation-in-part of 07/238,848 filed Sep. 1, 1988 which is now U.S. Pat. No. 4,934,440.

BACKGROUND OF THE INVENTION

1. Field of the Invention

This invention relates to a surface treatment process for smoothing surfaces of molds and cores of a mold (hereinafter collectively referred to as a mold) composed mainly of sand and a mold produced by this method.

2. Description of the Background

Conventionally, a mold uses relatively coarse sand since it requires strength and permeability. Accordingly, metal penetration often occurs, that is, molten metal penetrates into the mold walls, and the casting is not easily removed off the mold.

In addition, some castings may be used as it is without finishing. Namely, the casting with as-cast surfaces may sometimes be used as a product. Roughness of as-cast surfaces may even determine the value of product. However, castings made by using the mold made of coarse sand hardly had fine cast surfaces. In general, a rough cast surface usually does not give good accuracy and appearance.

Thus, it has been employed to coat the surfaces of mold with fine sand. As done in the coating, an alcohol, water and a binder if necessary, are added to the fine sand to make slurry, and the slurry is applied on the surfaces by brushing, spraying, and dipping.

However, the coating process requires a drying process. Cracks and blisters occur during the drying, and the coating material tends to peel off the surfaces. Further, when the coating material is likely to adsorb water, it takes a lot of time to dry the coating material. Accordingly, the number of drying processes and the manufacturing cost increase. Furthermore, if the coating material is not dried sufficiently, water adsorbed in the coating material vaporizes during casting, and the generated gas may cause defects.

The problems mentioned above will be described briefly with reference to FIGS. 9 and 10. When a mold surface 31 is rather coarse as shown in FIG. 9, molten metal 5 penetrates into depressions between casting sand particles 30 of the mold surfaces 31 to cause metal penetration 51 and makes the cast surface rough. The mold surface 31 is coated with a coating material 6 in a wet process as shown in FIG. 10 to make the cast surface smooth. But it requires a drying process to dry the coating material 6, and the coating material 6 tends to peel off easily. In addition, the uneven thickness of coating material 6 adversely affects the accuracy of the mold, and a running 61 of coating material 6 due to the surface tension occurs at the edge of mold. The running 61 results in uneven thickness of coating material 6, and adversely affects the dimensional accuracy of product.

Further, the shell molding process has been widely employed for manufacturing a mold. This is because a casting with high dimensional accuracy can be obtained when casting is done with a mold manufactured by the shell molding process. The shell molding process utilizes the thermosetting property of a synthetic resin like phenolic resin. For casting sand, resin-coated sand is usually used in the shell molding process. The resin-coated sand is silica sand particles coated with a thermosetting resin like a phenolic resin. A cold setting resin like cold box is sometimes used in the shell molding process.

When casting molten aluminum, magnesium or an alloy thereof in a mold made of casting said coated with the cold setting resin or the thermosetting resin mentioned above (hereinafter referred to as resin) at a relatively low casting temperature, the resin decomposes insufficiently and gum generates. The gum adheres in gas vents, and blocks to let out the generated gas. The generated gas flows back to cavities of mold, and results in defective castings. To prevent this problem, the gum adhered in the gas vents should be cleaned so frequently that the cost for maintaining the mold increases.

In an attempt to resolve the above defect, Japanese Unexamined Patent Publication (KOKAI) No. 54244/1985 proposes a process for improving a mold surface defining shape of castings by introducing a mold in a fluidized bed of a pulverous refractory powder, vacuuming the mold in the fluidized bed and thereby filling up depressions of the mold with the treating powder. In this process, an evacuated space has to be provided at the opposite side from the mold surface defining the shape of castings. Therefore, this process is hardly employable for a mold having a complicated shape, because the power of sucking the pulverous refractory powder is weak at the complicated shape portion of the mold.

SUMMARY OF THE INVENTION

It is an object of this invention to provide a surface treatment process for smoothing surfaces of a mold composed mainly of sand, which makes molten metal less likely penetrate into the surfaces of the mold.

It is another object of this invention to provide a surface treatment process for smoothing surfaces of a mold which generates less amount of material causing defective castings such as gum during casting.

It is still another object of this invention to provide a surface treatment process for smoothing surfaces of a mold, which is capable of filling deep in the bottom of depressions on the surfaces of mold, free from employing a drying step.

Another object of this invention is to provide a mold having smooth surfaces, in which molten metal hardly penetrates into the walls of a mold.

A further object of this invention is to provide a mold, in which material causing defective castings such as gum is generated in less amount during casting.

Yet another object of this invention is to provide a mold having good accuracy, which gives a product with good dimensional accuracy and smooth and fine casting surfaces.

The process according to the present invention achieves these objects by contacting a mold composed mainly of sand with a fluidized bed of a treating powder and using surface treatment means for pushing the treating powder into the depressions of the mold surfaces. By employing this process, the depressions of the surfaces of a mold having complicated shape are uniformly filled up with the treating powder to smooth the mold surfaces. Surface treatment means may be a material having particle diameter larger than the treating powder and the diameter of each depression, in combination with means for moving the mold. Or, surface treatment means may be a flocked member having slidable feather members. The feather members slide on the surface of the mold to push the treating powder into the depressions of the mold.

The second feature of the process of the present invention is to employ an active substance as a treating powder. When the treating powder is active, the amount of gum generated during casting and causing defective castings is much reduced.

A mold of this invention comprises a mold body made mainly of sand and having depressions on surfaces, and an active treating powder to reduce gum generated during casting, whereby the treating powder fills up the depressions to make smooth mold surfaces. The active treating powder may be porous material such as hydrous magnesium silicate clay mineral, activated carbon or activated alumina.

The mold of this invention generates less amount of material causing defective castings such as gum during casting, and makes the molten metal less likely to penetrate into the walls of mold. Further, the mold has good accuracy, and gives a product with good dimensional accuracy and fine cast surfaces.

BRIEF DESCRIPTION OF THE DRAWINGS

The above and other objects, features and advantages of this invention will become more fully apparent from the following description taken in conjunction with the accompanying drawings, in which.

DETAILED DESCRIPTION OF THE INVENTION

Figure 1:
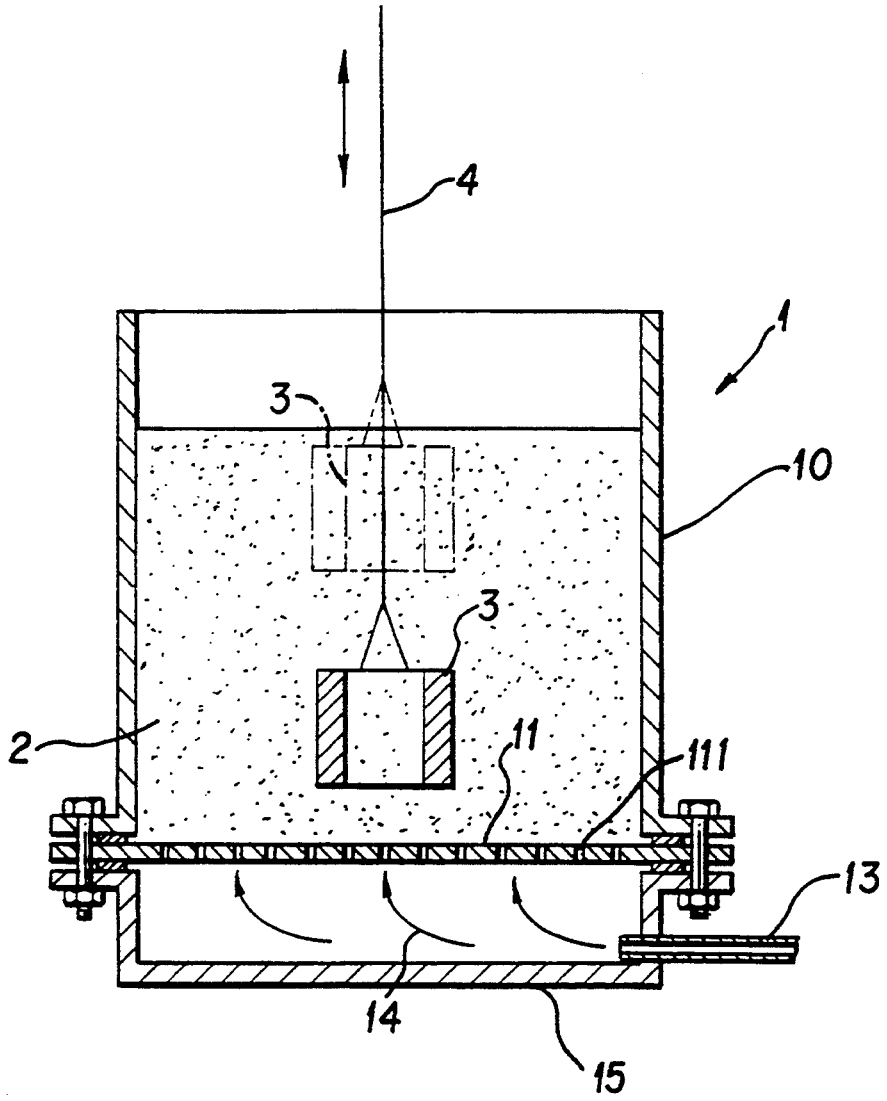
FIG. 1 is a schematic illustration of a mold surface treatment process of a first preferred embodiment according to this invention.

In the mold surface treatment process and the mold according to the present invention, the surfaces of a mold composed mainly of sand is made smooth by filling up the depressions of the mold surfaces with a treating powder.

The treating powder is at least one of clay mineral, natural mineral, synthetic mineral and activated carbon. The treating powder is powdered or granulated to fill up depressions of mold surfaces. The clay mineral may be sepiolite, palygorskite, diatomaceous earth, zeolite, vermiculite, etc. The natural mineral may be silica sand, chromite sand, zircon sand, etc. The synthetic mineral may be alumina, synthetic mullite, fused silica, etc.

The treating powder is preferably active because it is appropriate for suppressing gum generation during casting of shell molds. The treating powder may be one or a mixture of the following porous material: hydrous magnesium silicate clay mineral, activated carbon and activated alumina.

The hydrous magnesium silicate clay mineral is mainly composed of hydrous magnesium silicate, and has large specific surface area of from 100 to 400 $m^2/g$. Namely, the hydrous magnesium silicate clay mineral is sepiolite, xylotile, loughlinite, falcondoite and palygorskite composed mainly of hydrous aluminum silicate. It is a mineral normally called as mountain cork, mountain wood, mountain leather, meerschaum and attapulgite.

The activated carbon has large specific surface area of from 400 to 2000 $m^2/g$. It may be composed of plant such as coconut shell carbon and crude ash, or mineral produced of coal or petroleum.

The activated alumina is obtained by heating hydrated alumina at high temperature, and has specific surface area of from 50 to 400 $m^2/g$. It is an intermediate alumina product to $\alpha$-alumina. The intermediate alumina product contains $\rho$-, $\chi$-, $\dot{\eta}$-, $\gamma$-, $\delta$-, $\theta$- and $\kappa$-aluminas, and boehmite.

As for particle diameter of the treating powder, it is preferred to be so fine that the treating powder gets into the depressions of mold surfaces, and that the particle diameter is 200 $\mu$m or less. When it exceeds 200 $\mu$m, smooth surface layer is difficult to be obtained. It is especially preferred that the particle diameter falls within the range of from 1 to 150 $\mu$m. When it is less than 1 $\mu$m, the treating powder is hardly fluidized and tends to spill out of the fluidized bed processing equipment. When it is more than 150 $\mu$m, the treating powder becomes less likely to get into the depressions. Thus, a smoother and finer surface layer is obtained by making the particle diameter fall within the range of from 1 to 150 $\mu$m.

The mold surface treatment process of the present invention comprises: a first step of providing a fluidized bed of a treating powder; a second step of holding the mold in the fluidized bed and filling up depressions of the mold surfaces with the treating powder by employing surface treatment means for pushing the treating powder into the depressions; and a third step of taking the mold out of the fluidized bed.

Hereinafter, the surface treatment process using a pushing powder as surface treatment means will be described.

The pushing material is in a fluidized bed mixed with the treating powder and functions to push the treating powder into the depressions so that the depressions are filled up with the treating powder located adjacent the depressions of mold surfaces and in contact with the surface treatment means. The pushing material may be at least one of clay mineral, natural mineral, synthetic mineral and activated carbon. The depressions of the mold are filled up with the treating powder in contact with the mold by the pushing action of the pushing material in contact with the mold. This action is accelerated by employing means for moving the mold.

The pushing material is preferred to be larger in particle diameter or density, or in both of them, than the treating powder, so that the action of the pushing material is well applied to the treating powder in the direction to the depressions. In addition, the pushing material is preferred to be circular and to have a particle diameter of from 50 to 10,000 μm. When the particle diameter is less than 50 μm, the original objects of this invention will not be accomplished since the pushing material adheres more on the mold surfaces than the treating powder does. When the particle diameter is greater than 10,000 μm, the fluidizing gas for fluidizing the pushing material must be supplied much more and the treating powder comes to spill out of the fluidized bed processing equipment. It is especially preferred that the particle diameter falls within the range of from 150 to 500 μm. When it falls within the range, the objects will be achieved much more efficiently. Furthermore, the particle diameter of the pushing material is preferred to be larger than the diameter of each depression between the sand particles in the mold surfaces. The pushing material may be at least one of clay mineral, natural mineral, synthetic mineral, and activated carbon.

First, the treating powder and the pushing powder are fluidized by a fluidizing gas like air to provide a fluidized bed. This can be conducted, for example, by employing a fluidized bed processing means, as illustrated by FIG. 1.

Next, a mold is put in the fluidized bed of treating powder and the pushing material. The mold is hooked down and placed in the fluidized bed processing equipment. Then, the mold is repeatedly moved mainly in the vertical direction in order to fill up the depressions of the mold surfaces with the treating powder as uniform as possible to smooth the mold surfaces. But the mold may be moved in the back and forth direction and the horizontal direction as well. When filling up surfaces of a mold having a complicated cavity shape, the mold is moved not simply in one direction but in many directions combining various movements, so that the treating powder uniformly fills up the depressions of the whole surface without leaving a surface not filled up. Moreover, air, oxygen or an inert gas is introduced into the fluidized bed processing equipment from the lower parts thereof to fluidize the mixture of the treating powder and the pushing material. Dried air or heated air may be employed so that the treating powder does not adsorb the moisture contained in the atmosphere.

The mold surface treatment process has the filling step described above. The mold to be treated is held in the fluidized bed processing equipment in which the mixture of the treating powder and the pushing material is fluidized, and is moved in the vertical direction and other directions. Thus, the mold surfaces are filled up with the treating powder efficiently. No conventional drying step is required in the process of the present invention since the mold surfaces are filled up with the treating powder free from moisture. As a result, a mold having smooth surfaces can be obtained in which the metal penetration occurs less, and off which the castings are removed easily.

Figure 2:
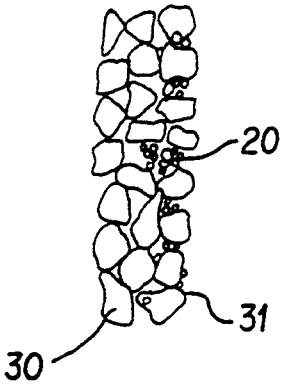
FIG. 2 is a schematic sectional view of a mold held in a fluidized bed processing apparatus of the mold surface treatment process of the first preferred embodiment of the present invention.
Figure 3:
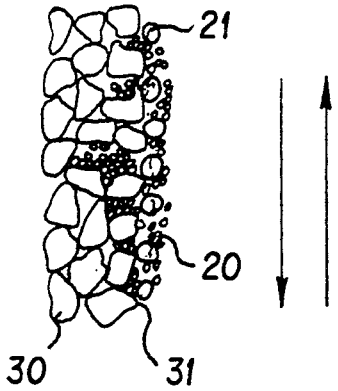
FIG. 3 is a schematic sectional view of the positional relationship between a mold, a treating powder and a pushing material in the mold surface treatment process of the first preferred embodiment of the present invention.
Figure 4:
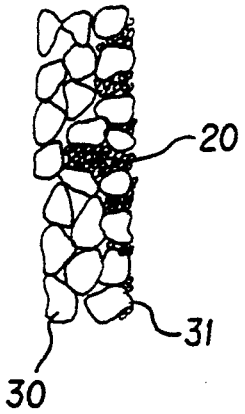
FIG. 4 is a schematic sectional view of a part of the mold treated by the mold surface treatment process of the first preferred embodiment of the present invention.

It is not still fully apparent what mechanism contributes to the advantages described above, but it is believed as hereinafter with reference to FIGS. 2, 3 and 4:

When only the treating powder 20 is fluidized to treat the mold surface, the depressions of the mold surfaces are filled up with the treating powder 20 in a certain degree, but the treating powder 20 does not reach deep in the bottom of gaps, or depressions between sand particles 30, and is also likely to spill out. On the other hand, when the mixture of the treating powder 20 and the pushing material 21 is fluidized and the mold is moved in the fluidized mixture, resistance force is exerted between the mold surface 31 and the pushing material 21. The resistance force pushes the treating powder 20 deep in the bottom of depressions. In other words, the treating powder 20 smaller than the depressions and the pushing material 21 larger than the depressions uniformly exist adjacent the depressions of mold surface 31. When the mold is moved in the vertical direction, the depressions move relatively with respect to the pushing material 21. The pushing material 21 exerts force to the treating powder 20 to push it into the bottom of depressions. As the mold is moved repeatedly, or as the pushing material 21 passes over the depressions again and again, the amount of the treating powder 20 in the depressions increases and finally the treating powder 20 fills up the depressions. Since the pushing material 21 travels while in contact with the mold surface 31, the excess treating powder 20 travels back and forth with the pushing material 21, and fills and closely packs the depressions which has room to be filled up with the treating powder 20. Thus, a smooth surface 31 is formed over the depressions after the pushing material 21 has passed by.

The excess treating powder 20 and pushing material 21 are blown off with compressed air in case they are depositing on the mold surface 31. In this way, a good mold is obtained which has the smooth surface shown in FIG. 4 as well as good dimensional accuracy. Accordingly, the mold allows the manufacturing of a good casting having smooth cast surfaces free from metal penetration.

The mold surface treatment process of the present invention may employ a flocked member as surface treatment means. The flocked member has slidable feather means, and moves relatively with respect to the mold surfaces and slides on the mold surfaces. Thus, the flocked member exerts force to the treating powder in the direction to the depressions to fill up the depressions of the mold surfaces with the treating powder.

Figure 5:
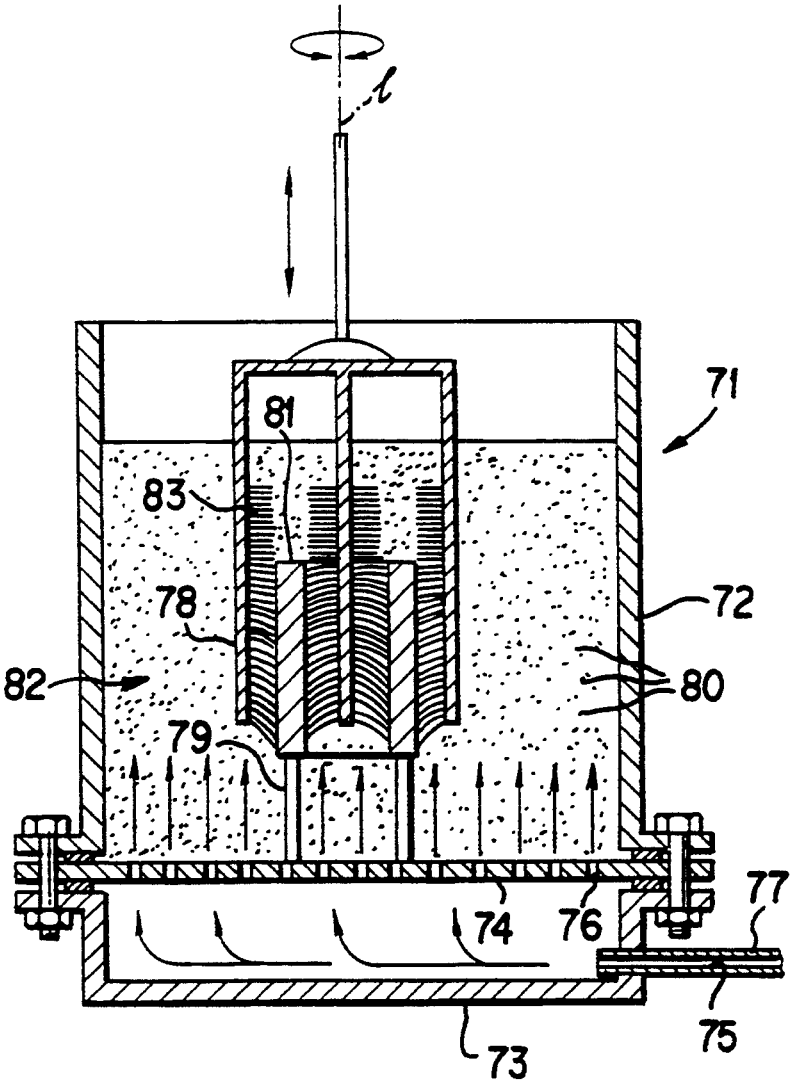
FIG. 5 is a schematic illustration of a mold surface treatment process of a fifth preferred embodiment of the present invention.
Figure 9:
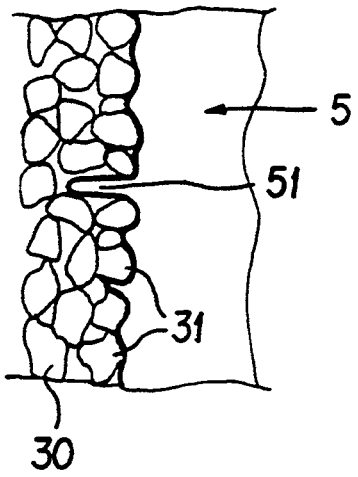
FIG. 9 (PRIOR ART)
FIG. 9 is a schematic sectional view of casting with a conventional mold.
Figure 10:
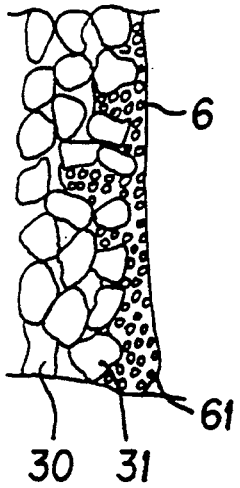
FIG. 10 (PRIOR ART)
FIG. 10 is a schematic sectional view of a mold coated with a conventional surface coating film.

This process may be conducted, for example, by another fluidized bed processing means, illustrated in FIG. 5.

A fluidized bed processing equipment 71 mainly comprises a body 72, a base 73 on which the body 72 is installed, and a porous board 74 placed between the body 72 and the base 73. The body 72 and the porous board 74 are bolted on the base 73.

The porous board 74 has mold receiving members 79, and fixes the mold 81 with fixtures (not shown) in the body 72. The base 73 and the porous board 74 form space between them, and the spaces are connected to the inside of body 72 through a plurality of tiny holes 76 of the porous board 74. A through hole 75 is provided in the side wall of base 73, and a nozzle 77 is inserted into the through hole 75 to introduce a fluidizing gas comprising air and the like into the inside of base 73.

A flocked member 78 is provided inside the body 72, and has a cylindrical body and a shaft disposed at the center. Feather members 83 are provided on the inner wall of cylindrical body and on and around the shaft so that they are in contact with the surfaces of mold 81. The flocked member 78 is rotated around a rotary axis "1" and moved in the vertical direction by a driving unit (not shown). In this way, the flocked member 78 is moved in desired directions, i.e., in the vertical direction, in the horizontal direction, in the rotational and in combined directions thereof. The feather members 83 slide over the surfaces of mold 81 fixed on the mold receiving members 79 when they are moved by the driving unit. The feather members 83 are so soft that they will not damage the surfaces of mold 81, and so elastic that they rub the treating powder 80 on the mold 81 and pushes the treating powder 80 deep in the bottom of the depressions in the surfaces of mold 81.

First, the treating powder 80 is provided in the body 72, and allows to obtain a product with fine cast surfaces. Namely, the treating powder 80 is introduced into the inside of base 73 through the nozzle 77, and fluidized with the fluidizing gas flow into the body 72 through the tiny holes 76. Thus, the treating powder 80 and the fluidizing gas forms a fluidized bed 82.

Next, the mold 81 is fixed on the mold receiving members 79, and the flocked member 78 is disposed over and around the mold 81. The fluidizing gas is then introduced into the inside of base 73 through the nozzle 77, and is introduced into the inside of body 72 through the tiny holes 76 to form the fluidized bed 82 in the body 72. Dried air or heated air may be employed for the fluidizing gas so that the treating powder 80 does not absorb the moisture contained in the gas in the fluidized bed 82.

Figure 6:
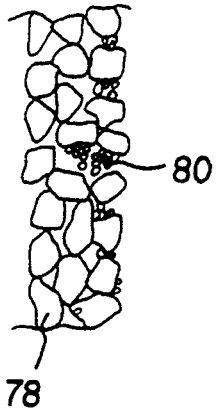
FIG. 6 is a schematic sectional view of a mold held in the fluidized bed processing equipment of the mold surface treatment process of the fifth preferred embodiment according to the present invention.

The driving unit is turned on to rotate the flocked member 78 around the rotary axis "1". The feather members 83 slide on the surfaces of mold 81 to rub the treating powder 80 on the surfaces of mold 81 to pat and push it into the depressions. Thus, the filling up the surfaces of mold 81 with the treating powder 80 is started as illustrated in FIG. 6.

Figure 7:
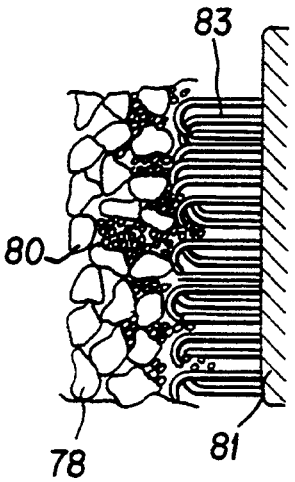
FIG. 7 is a schematic sectional view of the positional relationship between a mold, a treating powder and a flocked member having slidable feather members in the mold surface treatment process of the fifth preferred embodiment of the present invention.
Figure 8:
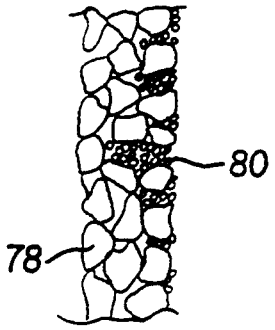
FIG. 8 is a schematic sectional view of a part of the mold treated by the mold surface treatment process of the fifth preferred embodiment of the present invention.

The flocked member 78 is moved to and fro in a desired direction by the driving unit while rotating around the rotary axis "1". In this way, the treating powder 80 is pushed deep into the bottom of the depressions and fills them up. As a result, the treating powder 80 in the fluidized bed 82 covers the whole surface of mold 81 uniformly as illustrated in FIGS. 7 and 8.

After this filling step, the mold 81 is removed from the mold receiving members 79, and taken out of the fluidized bed processing equipment 71. The mold 81 is then transferred to the next process. It is not necessary to dry the mold 81.

The mold surface treatment process employing the flocked member allows the treating powder to get deep into and fill up the depressions of the mold surface. Accordingly, the accuracy of mold improves, and the dimensional accuracy of product is also improved, since the depressions of mold surfaces are uniformly filled up. The advantage has been obtained since the treating powder 80 in the fluidized bed 82 is slided on the surfaces of mold 81 by the feather members 83 of flocked member 78. In this way, the treating powder 80 can enter deep into and fill up the depressions of surfaces of mold 81. Further, no drying step is required since water is neither mixed with nor contained in the treating powder 80.

The mold of the present invention, having smooth surfaces for defining a cavity, comprises a mold body mainly of sand and having depressions on surfaces and a treating powder having particle diameter smaller than that of the sand, whereby the depressions of mold surfaces are filled up with the treating powder. The treating powder is composed of at least one active material of hydrous magnesium silicate clay mineral, activated carbon and activated alumina. Owing to this construction, the mold is achieved to have smooth surfaces. Accordingly, the mold generates less amount of material causing defective castings such as gum during casting, and makes the molten metal less likely penetrate into the walls of mold.

It is not still fully understood why gum generation during casting is suppressed, but it is believed as hereinafter described. Namely, the gum has generated in less amount, since the gum components generated during casting would mainly comprise polymers, some of them could be adsorbed by the treating powder filling up the depressions of mold surfaces, and some of them could be decomposed to molecules with low molecular weight like water, carbon dioxide and methane by the catalyst action of treating powder. The active treating powders having large specific surface area are desirable because the contact area between the treating powder and the gum are enlarged and much more gum can be adsorbed by the active treating powder filled in the depressions of the mold.

In the mold of this invention, no foreign matters are intermingled in the mold itself and therefore the strength of mold does not decrease, since the mold depressions of mold surfaces are filled up with the treating powder. Further, the mold requires the treating powder less, the operation is done readily, and the manufacturing cost is reduced sharply, since no other step is required other than filling up the mold surfaces of the mold surfaces.

DETAILED DESCRIPTION OF THE PREFERRED EMBODIMENTS

First Preferred Embodiment

In this embodiment, with employing sepiolite as the treating powder having a specific surface area of approximately 280 m2/g mold surface treatments were conducted with varying the pushing material and number of vertical movements and ratios of the treating powder to the pushing material.

A mold 3 subjected to the surface treatment of this embodiment was a hollow cylinder having top outside diameter of 73 mm, bottom outside diameter of 80 mm, height of 110 mm, and thickness of 10 mm. The mold was made of resin coated casting sand which had particle size of JIS 65 (particle diameter 50 to 600 gm) and was composed of 100 parts by weight of silica sand and 2 parts by weight of phenolic resin.

The mold surface treatments of this embodiment were conducted by using a fluidized bed processing equipment 1 illustrated in FIG. 1. The fluidized bed processing equipment 1 comprises a body 10 in a rectangular parallel-piped shape, a porous, board 11 placed under the body 10, and a base 15. The base 15 is provided with a nozzle 13 for introducing a fluidizing gas. The body 10 has inside length of 330 mm, inside width of 350 mm and inside height of 400 mm.

First, each of the treating powder and the pushing material of Specimen Nos. 1 to 15 and Comparative Specimen Nos. C1 to C3 shown in Table 1 were mixed. Sepiolite A as the treating powder had particle diameter of 50 μm or less, and Sepiolite B, silica sand and circular mullite as the pushing material had particle diameter of 150 to 380 μm. The powder mixture was placed on the porous board 11 having a plurality of tiny holes 111, and a fluidizing gas 14 comprising air and the like was, introduced through the nozzle 13. The fluidizing gas 14 was blown out of the tiny holes 111 to fluidize the mixed powder at the air flow rates shown in Table 1, and thus a fluidized bed 2 was formed. Then, the mold 3 was hooked down with a hooking device 4 and put in the fluidized bed 2. Although the fluidized bed processing equipment 1 is capable of moving the mold not only in the vertical direction, the back and forth direction and the horizontal direction to have the treating powder enter into and fill up the depressions of surfaces of the mold 3 by the pushing action of the pushing material, the mold 3 was moved mainly in the vertical direction at predetermined times; 0, 20, 40 and 60 times in this embodiment. After taking the mold 3 out of the fluidized bed processing equipment 1, the excessive powdery mixture was removed by blowing compressed air.

Then, the amount of the treating powder attached to the mold was measured. The results are summarized in Table 1.

The amount of the treating powder attached to the mold 3 increased as the number of vertical movements increased. When the mold was not moved vertically, the amount of the treating powder attached to the mold 3 was extremely small, and the larger amount of the treating powder was attached at the lower part of the mold 3 than that at the upper part of the mold 3.

TABLE 1

| No. | Treating Powder (part by wt) | | Pushing Material (part by wt) | | Air flow Rate (l/min.) | Number of Vertical Movements | Treating Powder Attached amount ($g/m^2$) |
|---|---|---|---|---|---|---|---|
| C1 | Sepiolite A | 3.75 | Sepiolite B | 25 | 50 | 0 | 8.9 |
| 1 | Sepiolite A | 3.75 | Sepiolite B | 25 | 50 | 20 | 44.9 |
| 2 | Sepiolite A | 3.75 | Sepiolite B | 25 | 50 | 40 | 45.8 |
| 3 | Sepiolite A | 3.75 | Sepiolite B | 25 | 50 | 60 | 46.0 |
| C2 | Sepiolite A | 3.75 | Silica Sand | 100 | 130 | 0 | 9.7 |
| 4 | Sepiolite A | 3.75 | Silica Sand | 100 | 130 | 20 | 22.9 |
| 5 | Sepiolite A | 3.75 | Silica Sand | 100 | 130 | 40 | 32.4 |
| 6 | Sepiolite A | 3.75 | Silica Sand | 100 | 130 | 60 | 29.7 |
| C3 | Sepiolite A | 3.75 | Circular Mullite | 100 | 60 | 0 | 17.6 |
| 7 | Sepiolite A | 3.75 | Circular Mullite | 100 | 60 | 20 | 48.4 |
| 8 | Sepiolite A | 3.75 | Circular Mullite | 100 | 60 | 40 | 51.3 |
| 9 | Sepiolite A | 3.75 | Circular Mullite | 100 | 60 | 60 | 54.3 |
| 10 | Sepiolite A | 1 | Circular Mullite | 100 | 280 | 40 | 26.1 |
| 11 | Sepiolite A | 2 | Circular Mullite | 100 | 250 | 40 | 58.4 |
| 12 | Sepiolite A | 3 | Circular Mullite | 100 | 200 | 40 | 56.5 |
| 13 | Sepiolite A | 5 | Circular Mullite | 100 | 60 | 40 | 50.9 |
| 14 | Sepiolite A | 10 | Circular Mullite | 100 | <40 | 40 | 53.3 |
| 15 | Sepiolite A | 15 | Circular Mullite | 100 | <40 | 40 | uneven attachment |

When circular mullite was employed for the pushing material, the largest amount of the attached treating powder was obtained. Although the attached amount was comparatively large when the sepiolite was employed for the pushing material, sepiolite B having a small diameter as the pushing material shows a less tendency to help fill up larger depressions with the treating powder compared with the case where the circular mullite having a large particle diameter was employed for the pushing material. It is believed that this was because the treating powder would have been pushed by sepiolite B as the pushing material with less force in the direction to the depressions than that of the circular mullite.

When the silica sand was employed for the pushing material, larger amount of air was required to fluidize the mixture of the treating powder and the pushing material, but the attached amount was less.

In addition, when the sepiolite or the circular mullite was used for the pushing material, sepiolite A as the treating powder hardly spilled out and depressions of the mold surfaces was uniformly filled up with Sepiolite A. This was because less amount of air was required for fluidizing.

As for the ratio of sepiolite A to circular mullite, large attached amount was obtained when the sepiolite A was 2 to 3 parts by weight and circular mullite was 100 parts by weight. With using the molds of Specimen Nos.10, 12, 14, metal of aluminum alloy JIS AC2B was poured into the molds and castings were made to evaluate how much the molds generated gum. Specimen Nos. 10, 12 and 14 generated 0.066 g, 0.052 g, and 0.048 g of gum respectively.

Second Preferred Embodiment

In this embodiment, surface roughness of castings made by the mold of the present invention and the mold without any surface treatment were examined by using the fluidized bed processing equipment 1 employed in the first preferred embodiment.

A mold subjected to the surface treatment of the second embodiment 2 was a rectangular parallelpiped with the top open. The mold had thickness of 20 mm, and a cavity having length of 70 mm, width of 70 mm and depth of 100 mm.

The treating powder and pushing material employed in this embodiment is shown in Table 2.

TABLE 2

| No. | Treating Powder (part by wt) | | Pushing Material (part by wt) | | Number of Vertical Movements | Casting Surface Roughness (μM) |
|---|---|---|---|---|---|---|
| 16 | Silica Sand | 10 | Circular | 100 | 50 | 35 |

TABLE 2-continued

| No. | Treating Powder (part by wt) | | Pushing Material (part by wt) | | Number of Vertical Movements | Casting Surface Roughness (μM) |
|---|---|---|---|---|---|---|
| | | | Mullite | | | |
| 17 | Circular Mullite | 10 | Circular Mullite | 100 | 50 | 35 |
| C4 | — | | — | | | 110 |

Both silica sand and circular mullite as the treating powder had particle diameter of 70 μm or less, while the circular mullite as the pushing material had particle diameter of 150 to 380 μm.

Each mixture of the treating powder and pushing material of Specimen Nos. 16 and 17 was fluidized in the fluidized bed processing equipment 1. The mold was put thereto and moved in the vertical direction 50 times. Then, the mold was backed up with steel jigs, and molten metal of aluminum alloy (AC2B as per JIS) at temperature of 700° C. was poured and cast in the mold. Casting was also made with the mold of comparative Specimen No. C4 without any surface treatment.

The roughness of the cast surface measured is also shown in Table 2. The mold surface treatment of the present invention reduced the cast surface roughness by nearly ⅓.

Third Preferred Embodiment

Gum generation during casting was examined by using molds treated with porous treating powder and nonporous treating powder, and mold without any surface treatment.

A mold used in this embodiment was produced of a commercially available resin coated casting sand, which was composed of 100 parts by weight of silica sand and 2 parts by weight of phenolic resin and had particle size of JIS 65. The mold body was formed into a cup shape having top outside diameter of 80 mm, bottom outside diameter of 71 mm, height of 137 mm, top inside diameter of 60 mm, bottom inside diameter of 52 mm and depth of 120 mm.

The inner and outer surfaces of the cup shaped mold was treated in the same manner as the second preferred embodiment. The treating powders shown in Table 3 had particle diameter of 50 μm or less. The amount of the treating powder attached to the mold is also shown in Table 3.

Casting was done by using the molds of the Specimen Nos. 18 to 23 of the present invention and the mold of comparative specimen No. C5 without any surface treatment. Molten metal of aluminum alloy (AC2B as per JIS) heated at 750° C. beforehand was poured into the molds and generated gum was measured as follows. With the receiving face down, a semisphere shaped evaporating dish having diameter of 145 mm was fixedly placed at 10 mm above the center of the mold to which the molten metal had poured exactly in ten seconds, so that the gum evaporating from the mold would attach to the receiving face. This process was repeated four times and the total weight of the gum generated during four times casting was measured. The amount of gum generated is shown in Table 3.

Table 3 clearly shows that the molds which were treated with the porous treating powder generated gum less by 20 to 50% than the mold of comparative No. C5 without any surface treatment done during casting. The mold treated with the non-porous treating powder generated more amount of gum than the mold treated with the porous treating powder.

Fourth Preferred Embodiment

The performances were compared between a mold which was made of resin coating sand and subjected to the surface treatment with sepiolite having a specific surface area of 300 $m^2/g$ as the treating powder and a mold which was made of resin coated sand with sepiolite added.

A mold was made of the same resin coated casting as employed by the third preferred embodiment, and had the same cup shape as the third preferred embodiment. The inner and outer surfaces of mold were subjected to the surface treatment with sepiolite in a ratio of 0.7 parts by weight per 100 parts by weight of resin coated casting sand for the mold in the same manner as the third preferred embodiment. Thus, the mold of specimen No. 24 was produced. The attached amount of sepiolite to the mold of Specimen No. 24 was 54.6 $g/m^2$.

Another mold having the same shape as that of the third preferred embodiment was made of a mixture of the resin coated casting sand and the sepiolite. Sepiolite by 0.7 parts by weight was mixed with 100 parts by weight of the resin coated casting sand. The mixture was formed into a mold by an ordinary process. The mold of comparative specimen No. C6 was thus produced.

Molten metal of aluminum alloy (AC2B as per JIS) was poured into the molds, and castings were made to evaluate how much the molds generated gum as described in the third preferred embodiment. A mold of specimen No. C7 without sepiolite coating or addition was also made, and evaluated how much it generated gum. The results of evaluation are summarized in Table 4.

TABLE 3

| No. | Treating Powder (part by wt) | | Pushing Material (part by wt) | | Number of Vertical Movements | Treating Powder Attached Amount ($g/m^2$) | Amount of Gum (g) |
|---|---|---|---|---|---|---|---|
| 18 | Sepiolite(1) | 3 | Circular Mullite | 100 | 50 | 60 | 0.040 |
| 19 | Coconut Shell Activated Carbon(2) | 3 | Circular Mullite | 100 | 50 | 34 | 0.046 |
| 20 | Coal Activated Carbon(3) | 3 | Circular Mullite | 100 | 50 | 40 | 0.069 |
| 21 | Activated Alumina(4) | | Circular Mullite | 100 | 50 | 69 | 0.057 |
| 22 | Silica Sand | 5 | Silica Sand | 100 | 50 | 58 | 0.080 |
| 23 | Nodular Mullite | 5 | Circular Mullite | | 50 | 42 | 0.076 |
| C5 | — | | — | | — | 0 | 0.083 |

(1)Specific surface area of sepiolite: approximately 280 $m^2/g$
(2)Specific surface area of coconut shell activated carbon: approximately 1050 $m^2/g$
(3)Specific surface area of coal activated carbon: approximately 600–1400 $m^2/g$
(4)Specific surface area of activated alumina: approximately 120 $m^2/g$

TABLE 4

| No. | Way of Sepiolite Application to Mold | Amount of Gum (g) |
|---|---|---|
| 24 | filling in the depressions of the mold surfaces | 0.050 |
| C6 | Adding to the Casting Sand | 0.085 |
| C7 | None | 0.095 |

It is obvious from Table 4 that the mold of specimen No. 24 reduced the amount of generated gum by nearly half of the mold of comparative specimen No. C7. Although the mold of specimen No. C6 had the sepiolite additive, adding that amount of sepiolite could not prevent generating much smoke. It should be noted also that the mold of specimen No. C6 made of the mixtures of resin coated casting sand and sepiolite generated as much gum as the mold of specimen No. C7.

Thus, the gum generation was reduced more by treating the surfaces of the mold with less amount of sepiolite in accordance with this invention than by adding sepiolite to the resin coated casting sand. In addition, according to strength evaluation, the mold of specimen No. C6 made of the mixture of resin coated casting sand and sepiolite was a little more brittle than the mold of this invention, specimen No. 24. It is believed that the brittleness resulted from the intermingling of foreign matter, the sepiolite, in the resin coated casting sand.

An analysis was done on molecular weights of gum components generated from the mold comprising the resin coated casting sand and surface treated with the sepiolite powder.

A cup shaped mold was subjected to surface treatment by using the sepiolite powder to prepare the mold of specimen No. 25 by the same process described in the third preferred embodiment. Another cup shaped mold without any surface treatment was also prepared as comparative specimen No. C8.

Molten metal of aluminum alloy (AC2B as per JIS) heated at 750° C. beforehand was poured into the molds for casting. The gum generated during casting was collected by 50 ml of chloroform in an impinger, and the molecular weights of gum components was analyzed with a gel permeation chromatography apparatus (GPC).

Figure 11:
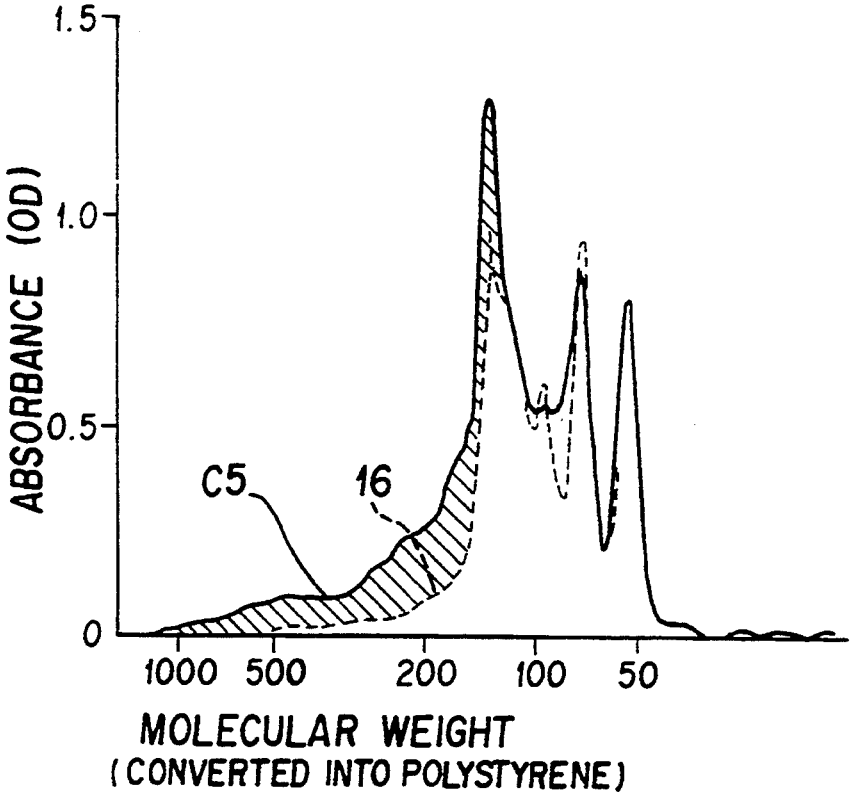
FIG. 11 is a diagram of a molecular weight analysis on gum generated in a mold surface treatment of a fourth preferred embodiment according to this invention.

The results are shown in FIG. 11. The horizontal axis of FIG. 11 expresses molecular weight of gum components converted into polystyrene, and the vertical axis expresses absorbance. The molecular weights of gum generated by the mold of specimen No. 25 is drawn with the dotted line, those by specimen C8 is drawn with the solid line.

As can be seen from FIG. 11, the molecular weight of gum components generated by the mold of specimen No. 25 without any surface treatment distributed over the wide range of 40 to 1,000. On the other hand, the molecular weight of gum generated by the mold of specimen No. 25 with surface treatment by the sepiolite distributed over a narrower range, and the gum having molecular weight which falls in the range of 150 to 1,000 was reduced. It is believed that polymers liable to be changed into the gum were decomposed catalytically by sepiolite into molecules having lower molecular weight such as water, carbon dioxide and methane.

Fifth Preferred Embodiment

The fluidized bed processing equipment 71 illustrated in FIG. 5 was employed as surface treatment means to fill up the depressions of the surfaces of mold 81 with the treating powder 80.

The mole 81 had a hollow cylinder shape with top outside diameter of 73 mm, bottom outside diameter of 80 mm, height of 110 mm and thickness of 10 mm. The mold 81 was made of resin coated casting sand, which was composed of 100 parts by weight of silica sand and 2 parts by weight of phenolic resin, and having particle size of JIS 65. For the treating powder 80, sepiolite having particle diameter of 50 μm or less and a specific surface area of 280 $m^2/g$ was used.

The fluidized bed processing equipment 71 had the body 72 having length of 330 mm, width of 350 mm and height of 400 mm, and the mold 81, was put and treated in it in accordance with this invention.

Using the mold 81, the combination of the revolving speed of the flocked member 78 and the number of the vertical movements of the mold 81 were examined. The flocked member 78 was revolved at three different speeds: 0, 30 and 60 rpm, while the mold receiving members 79 were moved also three different times, i.e. 10, 20 and 30 times, to move the mold 81 in the vertical direction. Thus, nine molds 81 designated at specimen Nos. 26 through 34 were prepared and evaluated about attached amount of the treating powder 80 to the mold. The results are shown in Table 5.

TABLE 5

| No. | Speed of Flocked Member (rpm) | Number of Mold Vertical Movements | Treating Powder Attahed Amount ($g/m^2$) |
|---|---|---|---|
| 26 | 0 | 10 | 32.8 |
| 27 | 0 | 20 | 34.5 |
| 28 | 0 | 30 | 33.9 |
| 29 | 30 | 10 | 39.0 |
| 30 | 30 | 20 | 42.8 |
| 31 | 30 | 30 | 45.1 |
| 32 | 60 | 10 | 42.3 |
| 33 | 60 | 20 | 49.6 |
| 34 | 60 | 30 | 56.2 |

As summarized in Table 5, the weight of the treating powder attached to the unit surface area of the mold 81, increased gradually as the speed of flocked member 78 increased and the number of vertical movements of mold 81, or the number of movements of mold receiving members 79 increased.

The mold of specimen No. 30 was taken as a representative of the molds 81 which had been subjected to the surface treatment of the present invention with the treating powder 80 and compared the cast surface performance with that of a mold without any surface treatment, i.e., a mold before the surface treatment. The castings were obtained by pouring the molten metal of aluminum alloy (AC2B as per JIS) heated at 700° C. beforehand in the two molds. The cast surface obtained by the mold of specimen No. 30 exhibited surface roughness of 32 μm, which was a value reduced by nearly ⅓ of 90 μm surface roughness exhibited by the mold without any surface treatment.

What is claimed as new and desired to be secured by letters patent of the United States is:

1. A mold comprising a cavity for defining the shape of a casting and a mold body for forming said cavity, comprising:

a mold body formed of an ordinary temperature setting resin or thermosetting resin and casting sand, said mold body having depressions in the surface thereof, said depressions at least in the surface thereof on the cavity side being filled up with a powdered gum reducing substance having a particle diameter of 200 μm or less selected from the group consisting of hydrous magnesium silicate clay mineral having a specific surface area of 100 $m^2/g$ to 400 $m^2/g$, activated carbon having a specific surface area of 400 $m^2/g$ to 2000 $m^2/g$ and activated alumina having a specific surface area of 50 $m^2/g$ to 400 $m^2/g$, in an amount sufficient to reduce gum generation and to prevent metal penetration into said depressions during casting, thereby providing the mold body with smooth surfaces while reducing gum generation.

2. The mold of claim 1, wherein said gum reducing substance has a particle diameter of from 1 to 100 micrometers.

3. A mold comprising a cavity for defining the shape of a casting and a mold body for forming said cavity, comprising:

a mold body formed of an ordinary temperature setting resin or thermosetting resin and casting sand, said mold body having depressions in the surfaces thereof, said depressions at least in the surface thereof on the cavity side being filled up with a powdered gum reducing mixture having a particle diameter of 200 μm or less of hydrous magnesium silicate clay mineral having a specific surface area of 100 $m^2/g$ to 400 $m^2/g$ and activated carbon having a specific surface area of 400 $m^2/g$ to 2000 $m^2/g$, in an amount sufficient to reduce gum generation and to prevent metal penetration into said depressions during casting, thereby providing the mold body with smooth surfaces while reducing gum generation.

* * * * *